United States Patent [19]

Janssen

[11] Patent Number: 4,566,816

[45] Date of Patent: Jan. 28, 1986

[54] PRESSURE FED PAINT ROLLER

[75] Inventor: Robert I. Janssen, St. Paul, Minn.

[73] Assignee: Padco, Inc., Minneapolis, Minn.

[21] Appl. No.: 527,412

[22] Filed: Aug. 29, 1983

[51] Int. Cl.[4] ..... B05C 17/02

[52] U.S. Cl. ..... 401/219; 401/208

[58] Field of Search ..... 401/218, 219, 220, 208, 401/139, 207, 140; 251/6

[56] References Cited

U.S. PATENT DOCUMENTS

| | | | |
|---|---|---|---|
| 789,970 | 5/1905 | Gowell | 401/140 |
| 2,647,273 | 8/1953 | Eagle | 15/130 |
| 2,677,839 | 5/1954 | Dean | 15/125 |
| 2,776,620 | 1/1957 | Quimby | 101/328 |
| 2,882,541 | 4/1959 | Easley | 15/128 |
| 2,898,618 | 8/1959 | Whitfield et al. | 401/219 |
| 2,988,769 | 6/1961 | Panfil | 15/522 |
| 3,030,652 | 4/1962 | Whitfield et al. | 401/218 |
| 3,113,335 | 12/1963 | Baicker | 401/139 |
| 3,134,130 | 5/1964 | Chadwick | 15/552 |
| 3,135,259 | 6/1964 | Evans | 251/6 X |
| 3,143,756 | 8/1964 | Sisko | 15/553 |
| 3,310,831 | 3/1967 | Brinker | 15/575 |
| 3,408,149 | 10/1968 | Lakes | 401/147 |
| 3,441,355 | 4/1969 | Brown | 401/219 |
| 3,457,017 | 7/1969 | Bastian | 401/146 |
| 3,549,267 | 12/1970 | Wurzer et al. | 401/147 |
| 3,630,481 | 12/1971 | McGay | 251/6 |
| 3,640,630 | 2/1972 | Walker | 401/183 |
| 3,694,097 | 9/1972 | Fedorek | 401/207 X |
| 3,776,645 | 12/1973 | Walker | 401/188 |
| 3,826,581 | 7/1974 | Henderson | 401/197 |
| 3,918,820 | 11/1975 | Kim | 401/152 |
| 3,933,415 | 1/1976 | Woolpert | 401/145 |
| 4,072,429 | 2/1978 | Terzian et al. | 401/208 X |
| 4,140,410 | 2/1979 | Garcia | 401/150 |
| 4,222,678 | 9/1980 | Miller | 401/218 |

FOREIGN PATENT DOCUMENTS

| | | | |
|---|---|---|---|
| 822837 | 10/1951 | Fed. Rep. of Germany | 401/208 |
| 2007765 | 9/1971 | Fed. Rep. of Germany | 401/219 |
| 2309477 | 8/1974 | Fed. Rep. of Germany | 401/208 |

OTHER PUBLICATIONS

Berger/Black & Decker "Paintmate", Brochure.

Miller "The Paint Machine", Brochure, The K. J. Miller Corporation.

"The Wagner Power Roller Home Interior Painting System", Brochure.

*Primary Examiner*—Steven A. Bratlie

*Attorney, Agent, or Firm*—Kinney & Lange

[57] ABSTRACT

A pressure fed paint roller includes a paint roller shield and handle, a paint roller mounted for rotation within the shield, and a two-piece floating manifold positioned between the top of the shield and the roller. The manifold has a concave paint spreading surface with a row of spaced discharge openings from which paint is discharged under pressure onto the roller surface. An adjustable resilient loop connected between the manifold and the shield urges the manifold toward the roller so that this paint spreading surface engages the paint roller and forces the paint into the outer covering of the roller without impeding rotation of the paint roller.

21 Claims, 9 Drawing Figures

PRESSURE FED PAINT ROLLER

BACKGROUND OF THE INVENTION

1. Field of the Invention

The pesent invention relates to paint applicators. In particular, the present invention relates to a "self-feeding" or "pressure fed" paint roller.

2. Description of the Prior Art

Paint rollers have found wide use in applying paint to walls, ceilings, and other surfaces. A paint roller generally includes a cylindrical roller cover which is rotatably attached to a handle and frame assembly. The roller cover is formed by a cylindrical core or tube which has a fabric covering bonded to its outer surface. In most cases, the application of paint with a paint roller has also required the use of a paint tray. Paint is poured into the paint tray, and the paint roller is rolled in the tray to load the covering of the roller cover with paint. The paint roller is then rolled over the surface to be painted, and the paint carried by the roller cover is applied to the surface.

Over the years, there have been numerous proposals for a self-feeding or pressure fed paint roller system. The purpose of these proposed systems is to avoid the need for a paint tray and the periodic reloading of the roller cover with paint. In theory, this should make painting quicker and easier.

In general, the self-feeding paint roller systems proposed in the past include a pressure tank or pump which delivers paint under pressure through a flexible conduit or tube to the paint roller. The paint roller used in the self-feeding paint roller system has been one of two general types.

In the first type of self-feeding paint roller, the pressurized paint is supplied through the handle and supporting frame into the hollow center of the paint roller cover. The inner core of the roller cover is perforated and the paint is forced outward under pressure through the perforations into the fabric covering. Examples of this type of self-feeding paint roller include the Wagner Power Roller sold by Wagner Spray Tech of Plymouth, Minn. Other examples of this type of system are shown in the following United States Patents:

| | |
|---|---|
| Walker | 3,640,630 |
| Henderson | 3,826,581 |
| Dean | 2,677,839 |
| Woolpert | 3,933,415 |
| Bastian | 3,457,017 |
| Walker | 3,776,645 |
| Chadwick | 3,134,130 |

There are several significant disadvantages to this first type of self-feeding paint roller. First, the paint must be fed into the center of the paint roller cover and the ends must be sealed to prevent the paint from leaking out. As a result, this type of roller has tended to be complicated, has required extra parts in order to perform the sealing function, has been less reliable, and has required more maintenance.

Second, the roller cover core has required an extra perforating operation, and the supporting frame has reqired a hollow passage rather than a solid wire construction. These factors have led to an unusually high cost when compared to normal paint roller construction.

Third, the paint rollers of this first type have additional weight during operation because the center of the roller cover is completely filled with paint. The center of a standard paint roller, on the other hand, is hollow.

Fourth, the user's choice of roller covers is limited to those which are compatible with the remainder of the system.

The other type of self-feeding paint roller which has been proposed in the past applies paint to the outer surface of the roller cover through some sort of feed tube or manifold mechanism which typically runs parallel to the surface of the roller cover. This feed tube mechanism deposits paint onto the roller covering. One commercially available example of this type of pressure fed paint roller is the Miller Paint Machine sold by K. J. Miller Corporation, Broadview, Ill. Other examples of this second type of self-feeding paint roller are illustrated in the following United States patents:

| | |
|---|---|
| Brinker | 3,310,831 |
| Wurzer et al. | 3,549,267 |
| Garcia | 4,140,410 |
| Terzian | 4,072,429 |
| Sisko | 3,143,756 |
| Panfil | 2,988,769 |

This second type of self-feeding paint roller has also exhibited significant shortcomings in the past. One of the main complaints in painting with rollers in general is the messy spray that is thrown off the outside of the roller as it spins. This spray falls on the painter's hand, clothing, face and hair, and is a mess to clean up if it gets on the floor or surrounding moldings. In those self-feeding paint rollers in which the paint is applied to the outer surface of the roller cover, there has been a greater than normal tendency for the paint to flip off and spray. It also has been common for an excess amount of paint to be fed onto the roller, carried around a full revolution, and then build up again on the back side of the feed tube or manifold, thereby causing dripping and running of paint.

There is a continued need for an improved self-feeding paint roller which is simple in construction, is low cost, is compatible with conventional roller covers, is reliable and easy to maintain, is easy to clean after use, and reduces the tendency of the paint to spatter, drip or run.

SUMMARY OF THE INVENTION

The present invention is a self-feeding or pressure fed paint roller which includes a paint roller shield and handle, a paint roller mounted for rotation within the shield, and a floating manifold which is positioned between the top of the shield and the roller. The manifold has a concave paint spreading surface with a row of spaced discharge openings from which paint is discharged under pressure onto the roller surface. The manifold is urged toward the roller by resilient bias means connected between the manifold and the shield. The resilient bias means, which is preferably an elastic loop, causes the paint spreading surface of the manifold to engage the paint roller so that paint discharged from the openings is gently forced into the outer covering of the roller.

In the preferred embodiments of the present invention, the manifold is a two-part assembly which includes an upper manifold plate and a lower manifold plate which are connected together during normal operation, and which can be quickly disconnected to permit thorough cleaning of the manifold assembly. The upper manifold plate includes an inlet which is connected to a paint supply tube, and a channel in its lower surface which is connected to the inlet.

The lower manifold plate includes an upper surface which mates with the lower surface of the upper manifold plate, a lower surface which is the concave paint spreading surface, and a row of spaced discharge openings which extend through the lower manifold plate and are aligned with the channel in the upper manifold plate when the upper and lower manifold plates are connected together. Paint is supplied under pressure through the inlet to the channel, and out through the discharge openings onto the roller surface.

The inlet of the manifold assembly preferably extends upward through an opening in the top of the shield. The elastic band is mounted over the inlet and extends rearwardly and downwardly to a plurality of connection slots in a rear surface of the shield. By selecting the particular connection slots through which the lower end of the elastic band is threaded, the bias force applied to the manifold assembly can be selected so that the paint spreading surface of the manifold assembly engages the paint roller with sufficient force to force paint into the outer covering of the roller, without impeding rotation of the roller.

DETAILED DESCRIPTION OF THE PREFERRED EMBODIMENTS

Figure 1:
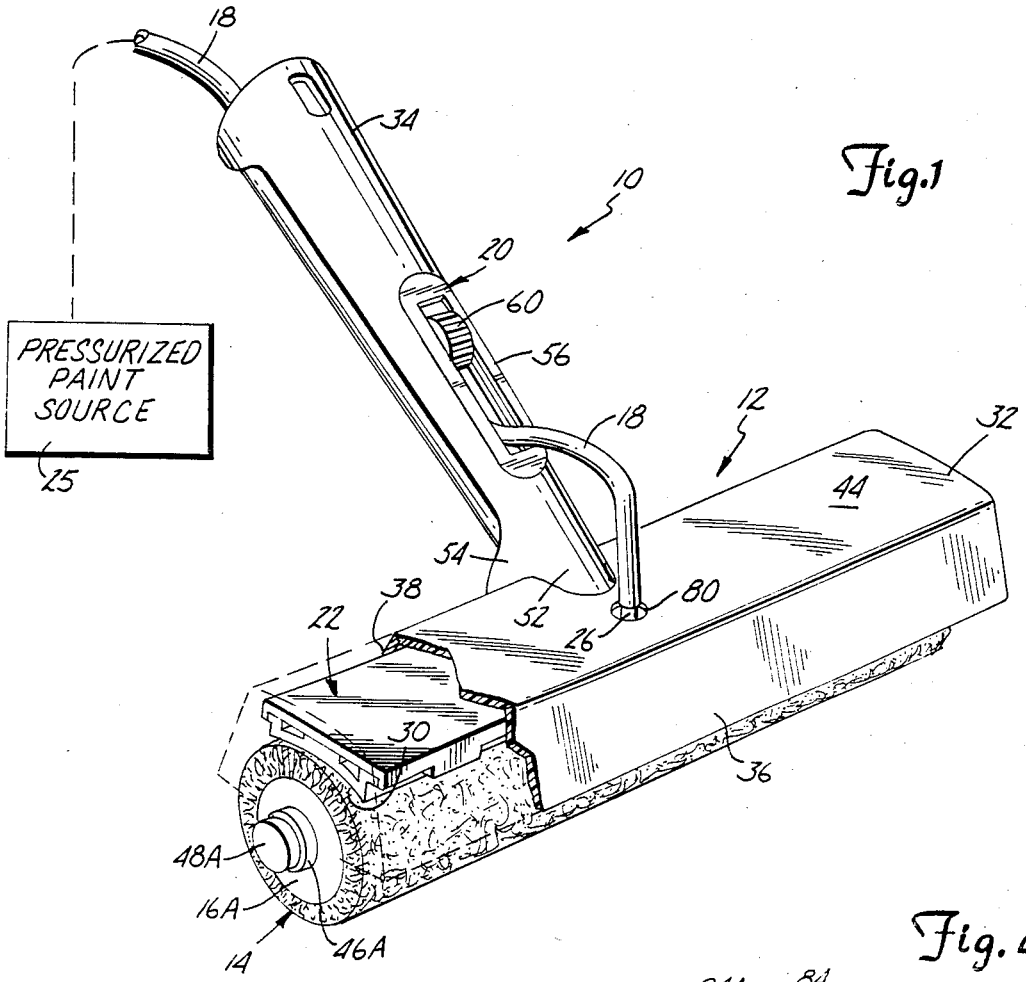
FIG. 1 is a perspective view of the pressure fed paint roller of the present invention, with portions broken away.
Figures 2, 3, 9:
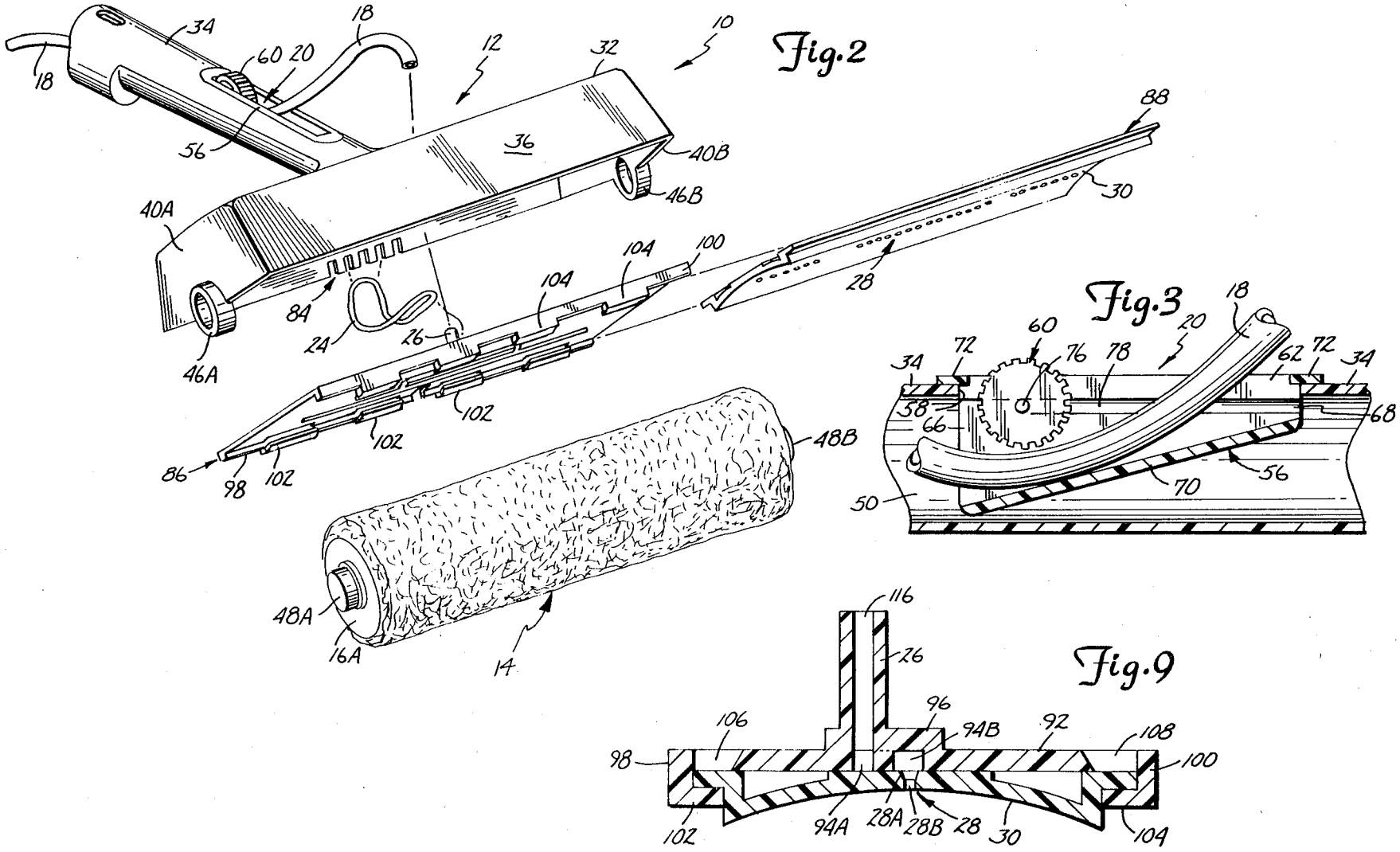
FIG. 2 is an exploded view, in perspective, of the pressure fed paint roller.
FIG. 3 is a sectional view of the handle and valve assembly of the pressure fed paint roller.
FIG. 9 is a sectional view of the manifold assembly along section 9—9 of FIG. 6.

As illustrated in FIGS. 1 and 2, pressure fed paint roller 10 of the present invention includes shielded roller frame 12, paint roller cover 14, end caps 16A and 16B, paint supply tubing 18, valve assembly 20, floating manifold assembly 22 and elastic band 24. Paint from pressurized paint source 25 (which is, for example, a pressurized supply reservoir or pump) is supplied under pressure through tubing 18 to inlet 26 of manifold assembly 22 and is discharged from manifold assembly 22 through discharge opening 28 onto the top surface of roller cover 14. The flow of the pressurized paint is controlled by valve 20, which provides a variable constriction of tubing 18. The manifold assembly 22 is urged by elastic band 24 toward roller cover 14, so that concave spreader surface 30 of manifold assembly 22 is in contact with roller cover 14.

Rather than simplying laying the paint on the outer surface of roller 14, manifold assembly 22 spreads and forces the paint down into the fibers of roller cover 14. The pressure applied to roller cover 14 by manifold assembly 22 is sufficient to gently force the pressurized paint into the roller, but is not so great that it impedes the ability of roller 14 to roll freely with respect to frame assembly 12.

Frame assembly 12 includes an integral shield 32 and handle 34, and is preferably of the construction shown in U.S. Pat. Nos. 4,254,529 and Des. 262,075, which are assigned to the same assignee as the present application.

Shield 32 has a generally rectangular front panel 36, a generally rectangular rear panel 38, a pair of generally trapezoidal end panels 40A and 40B, and a generally rectangular top panel 44, which form a shield which surrounds approximately the top one-half of roller cover 14. End panels 40A and 40B carry circular integral mounting aperture 46A and 46B, respectively. Apertures 46A and 46B receive and rotatably hold hubs 48A and 48B, respectively, of end caps 16A and 16B. Apertures 46A and 46B define an axis of rotation about which end caps 16A and 16B and roller cover 14 rotate. In preferred embodiments of the present invention, frame assembly 12 is molded as a one-piece unit from a synthetic polymer, preferably polypropylene, and the end panels 40A and 40B are sufficiently flexible so that roller cover 14 can be removed from frame assembly 12 by flexing the end portions to disengage hubs 48A and 48B from the corresonding apertures 46A and 46B.

Handle 34 is hollow, with a recess 50 which extends substantially the entire length of handle 34. Handle 34 is connected to shield 32 near the center of the intersection of top panel 44 and rear panel 38. Gusset 52 and web bracing portions 54 provide strength to the connection of handle 34 and shield 32.

Tubing 18 enters recess 50 at the other end of handle 34, and extends down recess 50 to valve assembly 20. As best illustrated in FIG. 3, valve assembly 20 includes valve body 56 and clamping roller 60. Valve body 56, which is press fitted into aperture 58 of handle 34, has a pair of side walls 62 and 64, a pair of open ends 66 and 68, a sloped bottom 70, and a top flange 72. Tubing 18 enters valve assembly 20 through an open end 66 and passes generally along the bottom 70 of valve body 56 until it passes out of valve body 56 over flange 72.

The amount of paint which is permitted to pass through tubing 18 is controlled by the position of clamping roller 60. Clamping roller 60 includes an integral pin 76 which extends out each side of roller 60. Side walls 62 and 64 of valve body 56 each include a camming channel 78 which receives and includes one end of pin 76. Camming channel 78 is arranged parallel to flange 68 and nonparallel to bottom 70 so that as clamping roller 60 is moved in a longitudinal direction toward shield 32, the distance between pin 76 and bottom 70 of valve body 56 is decreased. This causes an increasing amount of constriction of tubing 18 between clamping roller 60 and bottom 70 (and thus reduced paint flow to manifold assembly 22) as clamping roller 60 is moved toward shield 32.

Valve assembly 20 provides a simple and low-cost, yet highly effective valve for controlling flow of paint through tubing 18 to manifold assembly 22. There are only two operating parts of valve 20, both of which are of simple construction and can be manfactured on an inexpensive basis using conventional plastic molding techniques. Furthermore, the valve assembly 20 itself never comes into contact with the paint. This eliminates jamming or clogging of the valve mechanism, and also greatly simplifies the cleaning required after the painting has been completed.

After passing through valve assembly 20, tubing 18 extends downward toward shield 32 where it is connected at its lower end to inlet 26. Inlet 26 is a rigid, cylindrical hollow tube which is connected at its lower end to manifold assembly 22 and extends upwardly through aperture 80 in top panel 44 of shield 32.

Manifold assembly 22 is positioned within shield 32 between top panel 44 and the top portion of roller cover 14. Manifold assembly 22 "floats" in position, because it is not rigidly connected to either shield 32 or to roller cover 14. The length and width dimensions of manifold assembly 22 are only slightly less than the inner length and width dimensions of shield 32 near top panel 44. These dimensional relationships, together with the portion of inlet 26 which extends through opening 80 in top panel 44, maintain the general alignment of manifold assembly 22 with respect to shield 32 and roller cover 14, while permitting manifold assembly 22 to "float" in a radial direction with respect to the axis of rotation.

Figure 4:
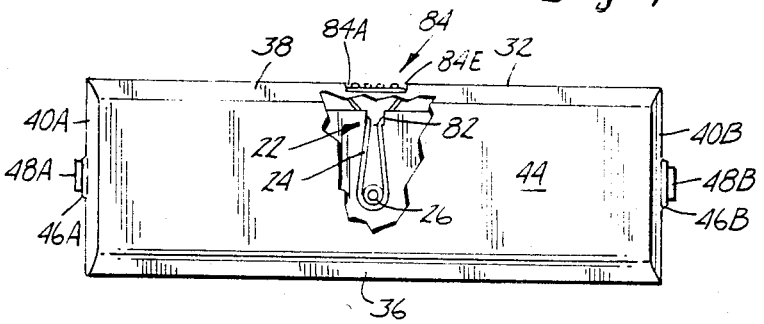
FIG. 4 is a top view of the pressure fed paint roller, with portions broken away.
Figure 6:
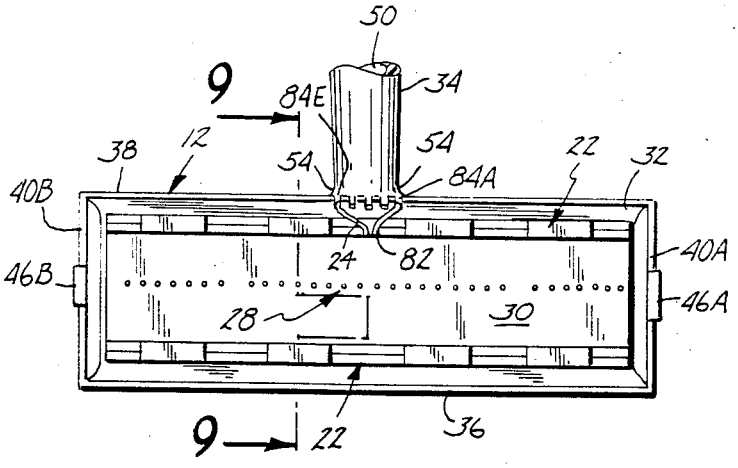
FIG. 6 is a bottom view of the pressure fed paint roller, with the roller cover removed.
Figure 5:
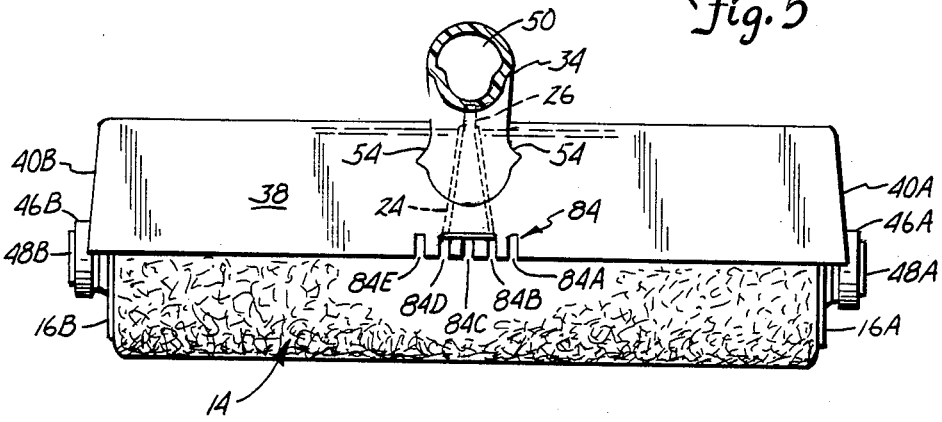
FIG. 5 is a rear view of the pressure fed paint roller.
Figure 7:
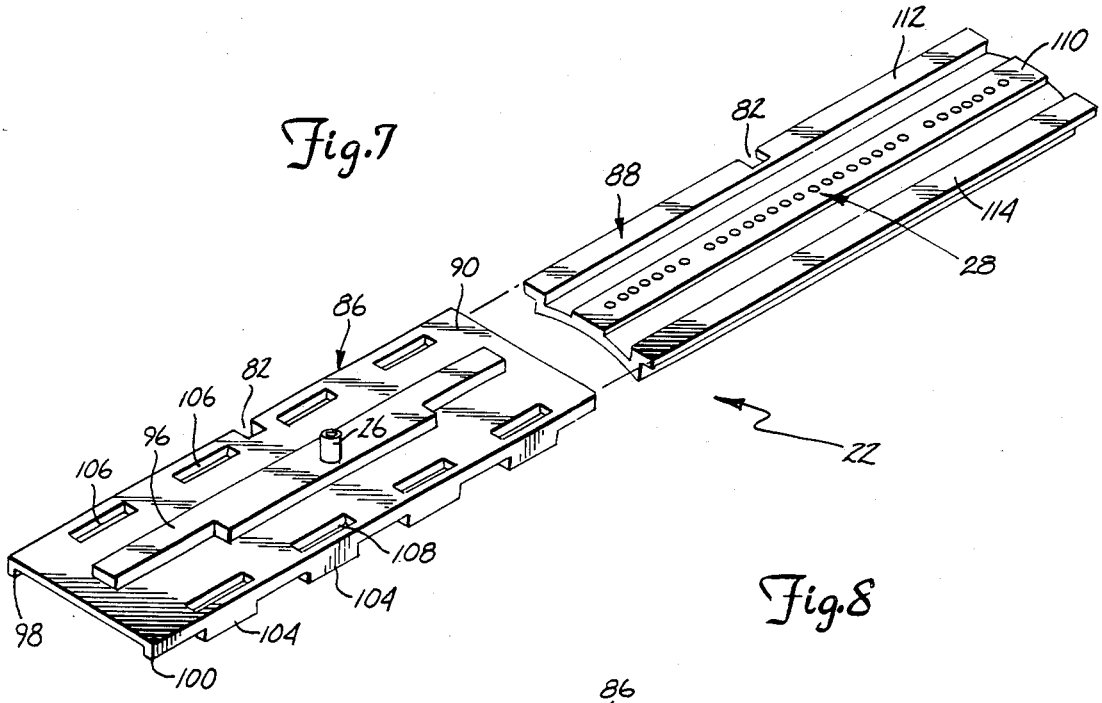
FIG. 7 is an exploded view, in perspective, of the mainfold assembly of the pressure fed paint roller.

Elastic band 24 applies a bias force to manifold assembly 22 which urges paint spreader surface 30 of manifold assembly 22 into contact with roller cover 14. As illustrated in FIGS. 2 and 4–6, the upper end of elastic band 24 is looped over inlet 26. Elastic band 24 extends rearwardly and downwardly over manifold assembly 22, through guide slot 82 in the center of the rear edge of manifold assembly 22, and down to connection slots 84 in the lower edge of rear panel 38. In the particular embodiment shown in the Figures, connection slots 84 include five spaced slots 84A, 84B, 84C, 84D and 84E. Elastic band 24 is threaded through at least two of the connection slots 84A–84B. In FIGS. 4 and 6, the lower end of elastic band 24 is shown threaded through slots 84A and 84E. In FIG. 5, the lower end of elastic band 24 is shown threaded through slots 84B and 84D. The particular combination of slots 84 through which elastic band 24 is threaded determines the amount of tension in elastic band 24, and thus the bias force which is applied by elastic band 24 to manifold assembly 22.

In the present invention, spreader surface 30 is wide enough so that the paint is actually forced down into the fibers of the fabric of roller cover 14, rather than simply being deposited on the outer surface. Elastic band 24, together with connection slots 84 permit the user to select the proper bias force to provide the correct amount of tension on band 24, and thus the proper amount of force which urges manifold assembly 22 toward roller cover 14 so that spreader surface 30 is pressed against the fabric of roller cover 14. The amount of force varies depending upon the characteristics of roller cover 14, as well as the viscosity of paint being used. The force must be sufficient to gently force the paint down into the roller cover, but must not be so great as to impede the ability of roller cover 14 to rotate freely.

With the present invention, excess paint build up on roller cover 14 is discouraged, and the paint is effectively metered onto the roller cover 14 regardless of the position of pressure fed paint roller 14. Gravity does not become a factor as in previous pressure fed paint rollers having an external manifold. The pressure fed paint roller of the present invention can be used upside down to paint a ceiling and in either vertical or horizontal strokes on walls.

As best illustrated in FIGS. 2 and 7–9, floating manifold assembly 22 of the present invention is preferably a two-piece plastic molded assembly which includes upper manifold plate 86 and lower manifold plate 88 which are connected together during normal operation, and which can be quickly and easily disassembled to permit cleaning and reassembled again for reuse.

Upper manifold plate 86 includes inlet 26, top surface 90, bottom surface 92, channel 94, channel cover 96, lateral guide rails 98 and 100, a plurality of hooks 102 connected to guide rail 98, a plurality of hooks 104 connected to guide rail 100, and a plurality of apertures 106 and 108. Lower manifold plate 88 includes discharge openings 28, concave spreader surface 30, closure surface 110 and flanges 112 and 114.

Figure 8:
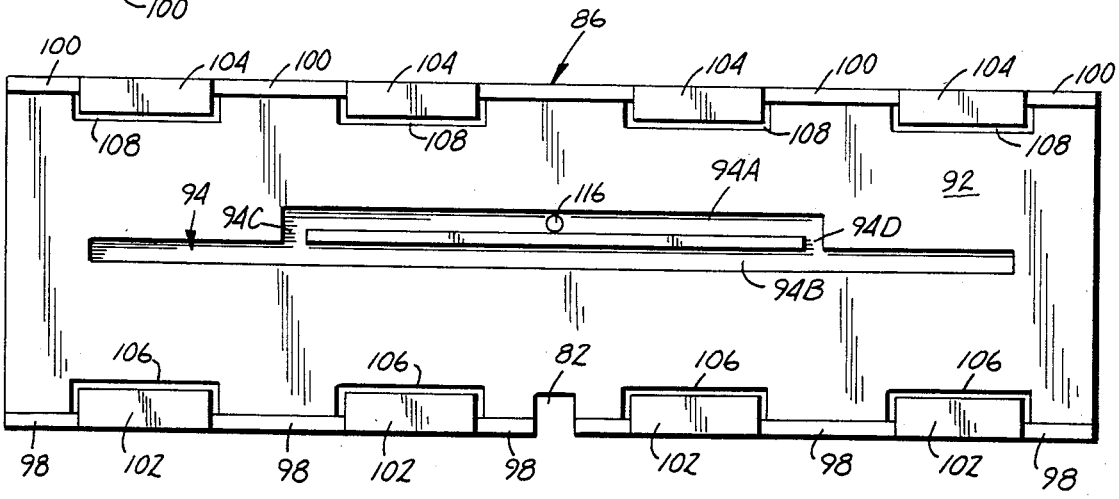
FIG. 8 is a bottom view of the upper manifold plate of the mainfold assembly.

Inlet 26 is a rigid hollow cylindrical tube which is attached at its lower end to channel cover 96 which has an inlet passage 116 which communicates with channel 94. As best illustrated in FIG. 8, channel 94 includes U-shaped auxiliary channel 94A and main channel 94B. Inlet passage 116 communicates with auxiliary channel 94A near its center. Main channel 94B is aligned with and communicates with discharge openings 28 of lower manifold plate 88. As paint is received from inlet passage 116, it is distributed in opposite directions along auxiliary channel 94A until it reaches sections 94C and 94D which are connected to main channel 94B. The paint then flows through sections 94C and 94D to main channel 94B. The paint received from section 94C flows both toward the center and toward one outer end of main channel 94B. Similarly, the paint received from section 94D flows both toward the other outer end and the center of main channel 94B.

The configuration of channel 94 shown in FIG. 8 has been found to be particularly advantageous, since it provides an essentially uniform distribution of paint along the entire length of main channel 94B. As a result, discharge openings 28 are all preferably the same diameter and are equally spaced, except at the intersections of main channel 94B with sections 94C or 94D where the spacing is slightly greater so that a discharge opening is not located at these intersections. The result is an essentially uniform distribution of paint along the entire length of roller cover 14 regardless of the flow rate selected by valve assembly 20.

Lateral guide rails 98 and 100 and hooks 102 and 104 provide a track into which flanges 112 and 114 of lower manifold plate 88 are inserted. When flanges 112 and 114 are inserted into the tack and upper and lower manifold plates 86 and 88 are joined together in their normal operating position, closure surface 110 underlies channel 94, and provides a sealed manifold chamber. As best shown in FIG. 9, discharge openings 28 preferably have an upper flared section 28A which has a diameter at its upper end which is slightly less than the width of channel section 94B. Flared section 28A of discharge opening 28 tapers down to a smaller diameter lower section 28B. In one preferred embodiment of the present invention, the diameter of discharge openings 28 at spreader surface 30 is about 0.031 inch and the discharge openings 28 are spaced apart on 0.200 inch centers except at the intersections of channels 94A and 94B where the spacing is 0.300 inch.

Apertures 106 and 108 in upper manifold plate 86 are positioned above hooks 102 and 104, respectively. The purpose of apertures 106 and 108 are to permit easy withdrawal of upper manifold plate 86 from a mold, since both plates 86 and 88 are preferably plastic molded parts.

In the preferred embodiments of the present invention, spreader surface 30 of lower manifold plate 88 has a width which is approximately equal to the outside diameter of roller cover 14, and has a radius which is slightly greater than roller cover 14. In a preferred embodiment in which roller cover 14 has a fabric covering wrapped on a 1.500 inch diameter core, spreader surface 30 has a width of about 1.742 inches and a radius of about 2.250 inches. This configuration of spreader surface 30 provides an even distribution of paint across the entire surface of roller cover 14, regardless of the orientation of roller 10 while applying paint.

In conclusion, the present invention is a pressure fed paint roller which efficiently meters paint onto the roller while minimizing the tendency of the paint to spray, drip or run. The present invention requires only relatively inexpensive molded plastic parts, requires minimal cleanup and maintenance, is extremely easy for the operator to use, and has much less tendency to spray or drip paint than the prior art self-feeding rollers.

Although the present invention has been described with reference to preferred embodiments, workers skilled in the art will recognize that changes may be made in form and detail without departing from the spirit and scope of the invention.

What is claimed is:

1. A pressure fed paint roller apparatus comprising:

a paint roller having a paint applying outer covering;

means for mounting the paint roller for rotation of the paint roller about an axis;

a paint supply tube for supplying paint under pressure;

a manifold having an inlet connected to the paint supply tube, a concave paint spreading surface facing the paint roller, a chamber within the manifold which includes an elongated main channel extending generally parallel to the axis of the paint roller and an auxiliary channel which communicates with the inlet and which is connected to the main channel at a plurality of spaced locations, and a row of spaced discharge openings extending from the main channel to the paint spreading surface through which paint is discharged from the chamber; and wherein the manifold comprises:

a first member which has the inlet connected thereto and has a first mating surface;

a second member having the concave paint spreading surface, having a second mating surface for mating with the first mating surface and having the row of spaced discharge openings therein;

wherein the main and auxiliary channels are formed in one of the mating surfaces; and means for releasably connecting the first and second members together so that when joined together in normal operating position, the first and second mating surfaces and the main and auxiliary channels define the chamber, and so that the upper and lower manifold plates are separable to expose the paint distribution channel and the first and second mating surfaces for cleaning; and means for urging the manifold toward the roller to cause the paint spreading surface to engage the paint roller for spreading paint evenly onto the outer covering of the paint roller.

2. The apparatus of claim 1 wherein the manifold has a width which is approximately equal to a diameter of the paint roller, and a radius of the concave paint spreading surface which is greater than a radius of the paint roller.

3. The apparatus of claim 1 wherein a first end of the auxiliary channel is connected to the main channel at a position between a center and a first end of the main channel, and wherein a second end of the auxiliary channel is connected to the main channel at a location between the center and a second end of the main channel.

4. The apparatus of claim 1 further comprising:

a paint roller shield partially surrounding the paint roller in a circumferential direction and having first and second ends;

a handle connected to the shield; and wherein the means for mounting the paint roller rotatably mounts the paint roller to the first and second ends of the paint roller shield.

5. Pressure fed paint roller apparatus comprising:

a paint roller having a paint applying outer covering;

a paint roller shield having first and second ends, a front side, a rear side and a top;

means for rotatably mounting the paint roller to the first and second ends of the shield to permit rotation of the paint roller about an axis essentially parallel to the top, front side and rear side of the shield;

a handle connected to the shield near an intersection of the top and rear side;

a flexible paint supply tube for supplying paint under pressure;

a manifold positioned within the shield between the top of the shield and the roller and having a concave paint spreading surface facing the paint roller, a chamber within the manifold extending generally parallel to the axis, an inlet connected to the paint supply tube, and a row of spaced discharge openings extending from the chamber through the paint spreading surface; wherein the manifold comprises:

an upper manifold plate which faces the top of the paint roller shield and which has the inlet connected thereto;

a lower manifold plate having the concave paint spreading surface facing the paint roller and having the row of spaced discharged openings;

wherein the upper manifold plate includes a bottom surface which faces the lower manifold plate, wherein the lower manifold plate has a top surface which faces the bottom surface of the upper manifold plate, and wherein one of the surfaces has a paint distribution channel therein;

means for releasably connecting the upper and lower manifold plates together, so that when joined together in normal operating position, the bottom surface of the upper plate and the top surface of the lower manifold plate mate together to define the chamber therebetween formed in part by the paint distribution channel which is in communication with the inlet and the discharge openings whereby paint supplied under pressure to the inlet is distributed through the chamber and discharged from the chamber through the discharge openings, and so that the upper and lower manifold plates are separable to expose the paint distribution channel and the surfaces of the plates for cleaning; and wherein the paint distribution channel includes an elongated main channel section which is aligned with the row of spaced discharge openings when the upper and lower manifold plates are jointed together, and includes an auxiliary channel section which communicates with the inlet, which has a first end connected to the main channel section at a position between a center and a first end of the main channel section, and which has a second end connected to the main channel section at a position between the center and a second end of the main channel section; and an elastic loop connected at one end to the manifold and at another end to the shield for urging the manifold toward the roller so that the point spreading surface engages the paint roller to force paint into the outer covering of the paint roller without impeding rotation of the paint roller.

6. The pressure fed paint roller apparatus of claim 5 wherein the shield includes a plurality of connection slots in a lower edge of the rear side, and wherein the elastic loop is connected at one end to the manifold and connected at another end to the connection slots.

7. The pressure fed paint roller apparatus of claim 6 wherein the one end of the elastic loop is connected to the inlet of the manifold.

8. The pressure fed paint roller apparatus of claim 7 wherein the inlet comprises a hollow upstanding tube which extends upwardly from the manifold through an opening in the top of the shield.

9. The pressure fed paint roller apparatus of claim 8 wherein the plurality of connection slots comprise at least three spaced parallel slots in the lower edge of the rear side, the slots being spaced from one another so that tension in the elastic loop, and therefore a force applied to the manifold which urges the manifold toward the roller, is dependent upon the spaced connection slots through which the other end of the elastic loop is threaded.

10. The pressure fed paint roller apparatus of claim 5 wherein the means for releasably connecting the upper and lower manifold plates together comprises:

a pair of generally parallel flanges positioned along opposite edges of one of the manifold plates; and at least one pair of hooks positioned along opposite edges of the other manifold plate to define a track which slidably receives and holds the flanges.

11. A pressure fed paint roller apparatus comprising:

a paint roller having a paint applying outer covering;

a paint roller shield partially surrounding the paint roller in a circumferential direction and including first and second ends;

means for rotatably mounting the paint roller to the first and second ends of the shield to permit rotation of the paint roller about an axis essentially perpendicular to the first and second ends;

a handle connected to the shield;

a paint supply tube for supplying paint under pressure;

a manifold positioned between the shield and the roller and having a concave paint spreading surface facing the paint roller, a chamber within the manifold extending generally parallel to the axis and having an inlet connected to the paint supply tube, and a row of spaced discharge openings extending from the chamber through the paint spreading surface; and wherein the chamber has an elongated main channel extending generally parallel to the axis and an auxiliary channel which communicates with the inlet and which is connected to the main channel at a plurality of spaced locations and wherein the spaced discharge openings are connected to the main channel; and wherein the manifold comprises:

a first member which has the inlet connected thereto and has a first mating surface;

a second member having the concave paint spreading surface, having a second mating surface for mating with the first mating surface and having the row of spaced discharge openings therein;

wherein the main and auxiliary channels are formed in one of the mating surfaces; and means for releasably connecting the first and second members together so that when joined together in normal operating position, the first and second mating surfaces and the main and auxiliary channels define the chamber, and so that the upper and lower manifold plates are separable to expose the main and auxiliary channels and the first and second mating surfaces for cleaning; and means connected between the manifold and the shield for urging the manifold toward the roller causing the paint spreading surface to engage the paint roller for spreading paint onto the outer covering of the paint roller.

12. The apparatus of claim 11 wherein the manifold has a width which is approximately equal to a diameter of the paint roller, and a radius of the concave paint spreading surface which is greater than a radius of the paint roller.

13. The apparatus of claim 11 wherein a first end of the auxiliary channel is connected to the main channel at a position between a center and a first end of the main channel, and wherein a second end of the auxiliary channel is connected to the main channel at a location between the center and a second end of the main channel.

14. A pressure fed paint roller apparatus comprising:

a paint roller having a paint applying outer covering;

a paint roller shield for partially surrounding the paint roller in a circumferential direction;

means for rotatably mounting the paint roller to the shield to permit rotation of the paint roller about an axis;

a handle connected to the shield;

a paint supply tube for supplying paint under pressure;

a manifold positioned between the shield and the roller and having a concave paint spreading surface facing the paint roller, a chamber within the manifold extending generally parallel to the axis and having an inlet connected to the paint supply tube, and a row of spaced discharge openings extending from the chamber through the paint spreading surface; and wherein the manifold comprises:

an upper manifold plate which faces the top of the paint roller shield and which has the inlet connected thereto;

a lower manifold plate having the concave paint spreading surface facing the paint roller and having a row of spaced discharged openings;

wherein the upper manifold plate includes a bottom surface which faces the lower manifold plate, wherein the lower manifold plate has a top surface which faces the bottom surface of the upper manifold plate, and wherein one of the surfaces has a paint distribution channel therein; and means for releasably connecting the upper and lower manifold plates together, so that when joined together in normal operating position, the bottom surface of the upper plate and the top surface of the lower manifold plate mate together to define a sealed chamber therebetween formed in part by the paint distribution channel which is in communication with the inlet and the discharge openings whereby paint supplied under pressure to the inlet is distributed through the chamber and discharged from the chamber through the discharge openings, and so that the upper and lower manifold plates are separable to expose the paint distribution channel and the surfaces of the plates for cleaning; and means for urging the manifold toward the roller causing the paint spreading surface to engage the paint roller over an arc in the circumferential direction for spreading paint evenly onto the outer covering of the paint roller.

15. The apparatus of claim 14 wherein the manifold has a width which is approximately equal to a diameter of the paint roller, and a radius of the concave paint spreading surface which is greater than a radius of the paint roller.

16. The apparatus of claim 14 wherein the chamber has an elongated main channel extending generally parallel to the axis along essentially the entire length of the paint roller and an auxiliary channel which communicates with the inlet and which is connected to the main channel at a plurality of spaced locations and wherein the spaced discharge openings are connected to the main channel.

17. The apparatus of claim 16 wherein a first end of the auxiliary channel is connected to the main channel at a position between a center and a first end of the main channel, and wherein a second end of the auxiliary channel is connected to the main channel at a location between the center and a second end of the main channel.

18. A pressure fed paint roller apparatus comprising:

a paint roller having a paint applying outer covering;

a paint roller shield having first and second ends, a front side, a rear side, and a top;

means for rotatably mounting the paint roller to the first and second ends of the shield to permit rotation of the paint roller about an axis essentially parallel to the top, front, side and rear side of the shield;

a handle connected to the shield near an intersection of the top and rear side;

a flexible paint supply tube for supplying paint under pressure;

a manifold positioned within the shield between the top of the shield and the roller and having a concave paint spreading surface facing the paint roller, a chamber within the manifold extending generally parallel to the axis, an inlet connected to the paint supply tube, and a row of spaced discharge openings extending from the chamber through the paint spreading surface; wherein the manifold comprises:

an upper manifold plate which faces the top of the paint roller shield and which has the inlet connected thereto;

a lower manifold plate having the concave paint spreading surface facing the paint roller and having a row of spaced discharged openings;

means for releasably connecting the upper and lower manifold plates together, so that when joined together in normal operating position, a bottom surface of the upper manifold plate and an upper surface of the lower manifold plate are engaged to define a sealed chamber therebetween formed in part by a paint distribution channel in at least one of the surfaces which is in communication with the inlet and the discharge openings whereby paint supplied under pressure to the inlet is distributed through the chamber and discharged from the chamber through the discharge openings, and so that the upper and lower manifold plates are separable to expose the paint distribution channel and the surfaces of the plates for cleaning; and bias means connected between the manifold and the shield for urging the manifold toward the roller so that the paint spreading surface engages the paint roller to force paint into the outer covering of the paint roller without impeding rotation of the paint roller.

19. The pressure fed paint roller apparatus of claim 18 wherein the means for releasably connecting the upper and lower manifold plates together comprises:

a pair of generally parallel flanges positioned along opposite edges of one of the manifold plates; and at least one pair of hooks positioned along opposite edges of the other manifold plate to define a track which slidably receives and holds the flanges.

20. The pressure fed paint roller apparatus of claim 18 wherein the paint distribution channel includes an elongated main channel section which is aligned with the row of spaced discharge openings when the upper and lower manifold plates are joined together, and an auxiliary channel section which is aligned with the inlet and which is connected to the main channel section at a plurality of spaced locations.

21. The pressure fed paint roller apparatus of claim 20 wherein a first end of the auxiliary channel section is connected to the main channel at a position between a center and a first end of the main channel section, and wherein a second end of the auxiliary channel is connected to the main channel section at a location between the center and a second end of the main channel section.

* * * * *